US008287312B2

(12) United States Patent
Riemeijer et al.

(10) Patent No.: US 8,287,312 B2
(45) Date of Patent: Oct. 16, 2012

(54) ELECTRICAL CONNECTOR WITH SHELL AND STATUS SWITCH

(75) Inventors: Martijn Riemeijer, Turku (FI); Sjoerd Zwartkruis, Grave (NL)

(73) Assignee: Tyco Electronics Nederland BV, 'S-Hertogenbosch (NL)

( * ) Notice: Subject to any disclaimer, the term of this patent is extended or adjusted under 35 U.S.C. 154(b) by 0 days.

(21) Appl. No.: 12/930,193

(22) Filed: Dec. 30, 2010

(65) Prior Publication Data

US 2011/0165796 A1 Jul. 7, 2011

(30) Foreign Application Priority Data

Jan. 5, 2010 (EP) ..... 10075006

(51) Int. Cl.
*H01R 13/66* (2006.01)

(52) U.S. Cl. ..... 439/620.21; 439/944

(58) Field of Classification Search ..... 439/620.21, 439/188, 944, 668
See application file for complete search history.

(56) References Cited

U.S. PATENT DOCUMENTS

| | | | | |
|---|---|---|---|---|
| 4,392,708 | A * | 7/1983 | Bailey et al. | 439/668 |
| 4,598,970 | A * | 7/1986 | Takihara | 439/668 |
| 5,092,795 | A * | 3/1992 | Kitagawa | 439/668 |
| 6,077,126 | A * | 6/2000 | Peng | 439/668 |
| 6,908,343 | B1 * | 6/2005 | Hu | 439/668 |
| 6,923,687 | B2 * | 8/2005 | Wang | 439/668 |
| 7,416,428 | B1 * | 8/2008 | Hung et al. | 439/188 |
| 7,785,119 | B1 * | 8/2010 | Chiang | 439/188 |
| 2004/0224563 | A1 | 11/2004 | Zhu et al. | |
| 2006/0009082 | A1 | 1/2006 | Lin | |
| 2007/0286436 | A1 | 12/2007 | Isobe et al. | |
| 2009/0081904 | A1 | 3/2009 | Wang | |

FOREIGN PATENT DOCUMENTS

EP 2 028 729 A1 2/2009

OTHER PUBLICATIONS

Search Report issued by the European Patent Office, Munich, Germany, dated Jun. 15, 2010, for European patent application No. 10075006.6; 9 pages.

* cited by examiner

*Primary Examiner* — Tulsidas C Patel
*Assistant Examiner* — Travis Chambers
(74) *Attorney, Agent, or Firm* — Faegre Baker Daniels LLP

(57) ABSTRACT

The invention relates to a female electrical connector having a contact volume for receiving a jack, a shell for securing the position of the connector relative to a substrate and a status switch, which is adapted to be operated by inserting the jack into the contact volume. In order to provide for a smaller connector, the present invention provides that the switch is at least partially integrated into the shell.

34 Claims, 4 Drawing Sheets

ELECTRICAL CONNECTOR WITH SHELL AND STATUS SWITCH

BACKGROUND

The present invention relates to a female electrical connector comprising a contact volume for receiving a jack in a plug direction extending parallel to a longitudinal direction of the contact volume, a shell for securing the position of the connector relative to a substrate and a status switch, which is adapted to be operated by inserting the jack into the contact volume in the plug direction.

Electrical connectors of the above mentioned type can be connected to jacks or plugs of the tip-sleeve-, tip-ring-sleeve, tip-ring-ring-sleeve or the like type and are often used for connecting stereo jacks of loudspeakers or headphones to a multimedia device like MP3-players, mobile phones or computers. When the headphone or speakers are being connected to the device by inserting the jack into the female electrical connector, noise can occur, as contact sections, e.g. the tip or one of the rings of the above mentioned types of the jack pass contact members of the electrical connector. In order to avoid this noise, it is known to add a switch to the connector, which mutes the output of the device while inserting the jack. In the state of the art, such a switch is shaped as a separate part, which is added to the connector.

Another application of the connector is to connect the device to a low-voltage operation energy source. Here, the switch is used to shut down the operation energy during the insertion process of the jack in order to avoid a wrong connection or short circuit during the insertion procedure.

As the installation space for the connector is limited, especially if it is used with computers, mobile phones or MP3-players, the additional switch causes an unacceptable need for installation space in the device as well as higher costs for material and handling. In view of the disadvantages of the prior art mentioned above, an object underlying the invention is to provide an electrical connector with a switch, which needs less space for installation.

This object is achieved according to the invention for the female electrical connector mentioned in the beginning in that the switch is at least partially integrated into the shell.

SUMMARY

A connector according to the invention provides the switch function without the need of a separate switching device, resulting in a connector that fulfils the requirements on functionality, installation space and production costs. Furthermore, as only one part, namely the connector, and no additional switch needs to be handled during the production process of the device, the costs for installing the connection and the switching function are lower compared to the prior art.

The solutions according to the invention can be combined as desired and further improved by the following further embodiments that are advantageous on their own in each case.

Especially if the connector is installed in a mobile device, e.g. in an MP3-player, mechanical forces may act upon the jack in a radial direction running transverse to the longitudinal direction, which are passed into the connector. The forces may suffice in order to separate the connector from the substrate.

The substrate may be a printed circuit board that provides that for electrical connection of contact members of the connector that can be connected to the jack in a signal conductive manner. If the mechanical forces are too high, they may cause a separation of the connector from the substrate, thus causing a malfunction of the device.

In order to secure the connection between the substrate and the connector, the shell can be placed on a body part of the connector such that it encloses the body part and it can be affixed to the substrate. Mechanical forces transverse to the longitudinal direction acting on the body portion, in which the contact volume is arranged, can at least partially be absorbed by the shell and led into the substrate. Contact members of the connector can additionally guide those forces into the substrate.

In order to affix the shell to the substrate, it can for instance be screwed or glued to the substrate. As the contact members of the connectors have to be soldered to the substrate in any case, e.g. by reflow soldering, fixing the shell by soldering it to the substrate can be performed during the same process step. Fixation by soldering may lead to another advantageous effect, as it can provide for an electrical connection of the shell to the substrate, advantageously to a ground. The connection to ground of the shell can lead to an electrostatic discharge protection. Furthermore, the switch, which is at least partially integrated into the shell, can easily be electrically connected to the substrate in this manner. In order to affix the shell to the substrate, it can have at least one fastening member that is adapted to be fixed to the substrate, e.g. by screwing, gluing or soldering, possibly providing for an electrically conductive connection between the switch and the substrate.

According to another possible further embodiment, the shell can be fixed to the body part. For instance, the shell and the body part can comprise latching means, via which the shell is latched to the body part. Such a connector can easily be handled in one piece, e.g. by a vacuum nozzle of a pick-and-place machine.

In a further advantageous embodiment of the connector, the status switch can be formed at an end of the shell, the end facing against the plug direction. As the jack reaches the switch in this position before the insertion or plug procedure is finished, the switch can detect the insertion status of the jack even if it is only partially inserted into the connector early during the insertion process. Preferably, the status switch is being actuated by the jack in the beginning of the insertion process.

To obtain a switch, at least one separate switching element is necessary that interacts with the shell. Therefore, the switch may comprise a switching element separate from the shell that is moveable into and out of contact with the shell in dependence of the insertion of the jack into the contact volume. In particular, at least the separate switching element can elastically be displaced in the radial direction by the jack.

To achieve that the shell and the separate switching element can be brought into and out of contact in dependence of the insertion of the jack, the shell can at least partially overlap the separate switching element in the radial direction. In particular, at least a part of the shell can overlap a free end extending into the contact volume in a home position of the separate switching element in the radial direction. For example, the free end of the separate switching element can be displaced by the jack from the home position towards the shell at least until it reaches a deflected position, in which it is in contact with the shell, thus creating a normally open switch. In the home position, the normally open status switch is in an open or non-conductive state and in the deflected position the normally open status switch is in a closed or conductive state. In the closed state, the at least one fastening member can electrically conductively be connected to the separate switching element, creating a status signal in dependence on the insertion of the jack.

Alternatively, the separate switching element can be in electrical contact with the shell in its home position and e.g. the shell can section-wise be deflected by the jack, resulting in a disconnection of the shell and the separate switching element and hence creating a normally closed contact.

The separate switching element can be formed by a separate contact member adapted to electrically connect the jack with the substrate, which is electrically isolated from the shell in the open state of the status switch. The separate switching element can fulfil two functions, namely the switching function and contacting the jack. For instance, the separate contact member can be shaped for contacting a ground contact of the jack with the ground of the device. The jack can be shaped as a 2.5 mm, 3.5 mm or 6.5 mm audio jack or as a jack with a similar shape.

In order to fulfil the two above functions, the contact member can be elastically deformable or deflectable. For instance, the contact member can be held by a spring in the home position, the spring being connected to the shell or the body part of the connector. Also, the contact member can be of an M-shape, at least one of the two legs being fixable to the substrate and the middle portion of the contact member being deformable by the jack. A smaller and less expensive contact member can be achieved by using a Z-shape, the lower leg of the Z being connectable to the substrate and the upper leg of the Z projecting into the contact volume as long as the jack is not inserted. In the deflected position, the contact member can be in contact with the jack and with the shell, if the switch is shaped as a normally open contact.

In a further advantageous embodiment, the separate contact member or separate switching element can be the first contact member of the connector in the plug direction. The status switch can thus be activated early in the beginning of the plug procedure, avoiding unwanted short circuits or noise. The connector can comprise at least one further contact member that is arranged behind the first contact member and that can e.g. be used to transmit a signal or operation energy. Optionally, the connector can be shaped with yet another contact member arranged behind the two above mentioned contact members in the plug direction. Of course, the connector can comprise further contact members arranged behind the first contact member in the plug direction, these further contact members being adapted for signal or power transmission or other purposes.

According to another possible further embodiment, the status switch can comprise a switch contact for interacting with the separate switching element. The switch contact can be formed by a conductive section of the shell at its end facing against the plug direction.

The shell may be produced of an electrically conductive sheet metal, for instance by a punch process. During this punch process, a part of the sheet metal and thus of the shell can at least section-wise be separated from the remaining shell, this separate section forming the tongue-shaped switch contact. The switch contact is still a part of the shell. No separate connections between the switch contact and the shell need to be established.

The switch contact and in particular its fee end/the tip of the tongue can at least partially overlap the separate switching element in the radial direction and can be adapted to be elastically deflectable or deformable by the separate switching element or by the jack itself.

Furthermore, in this embodiment, the shell can reach up to the area of the front of the body part against the plug direction. As the distance between the front of the body part to the shell determines the length of a lever, via which the mechanical forces and the resulting torque caused by the jack are acting upon the connector, the arrangement of the shell in the area of the front of the body part creates a lever with a minimum length and therefore an effective fixture of the contact to the substrate.

The connector may comprise at least one further contact member adapted to contact the jack that is arranged at a distance from the switch in the plug direction. Thus, jacks with two or more poles can be used with the connector and e.g. operating power, symmetric signals, stereo audio signals and/or control signals can be transmitted.

For handling or assembling purposes, the connector can be formed with a collar at its front facing against the plug direction and projecting above the body part in the radial direction. This collar can enforce the opening of the contact volume for the jack and protect contact ends of the contact member as well as fastening members of the shell during the handling process of the connector against deformation. Furthermore, the shell may abut against the front and e.g. against the collar, which may thus be used as a limit stop for the assembly of the shell and simplifies the assembly of the connector. Yet, the connector can be shaped without a collar, the shell still ending at the front.

The connector may comprise more than one contact volume, the additional contact volumes being shaped with a status switch according to the invention or without a switch. Furthermore, the status switch can be arranged at a distance from the first contact member in plug direction, detecting a state of insertion of the jack in the middle or at the end of the insertion procedure. Especially, the switch can be shaped as a final position switch, detecting that the jack is completely inserted into the contact volume. Furthermore, two or more status switches can be provided, for instance one status switch in the area of each end of the contact volume.

The invention will be described hereinafter in greater detail and in an exemplary manner using advantageous embodiments and with reference to the drawings. The described embodiments are only possible configurations in which, however, the individual features as described above can be provided independently of one another and can be omitted in the drawings.

DETAILED DESCRIPTION

Figure 1:
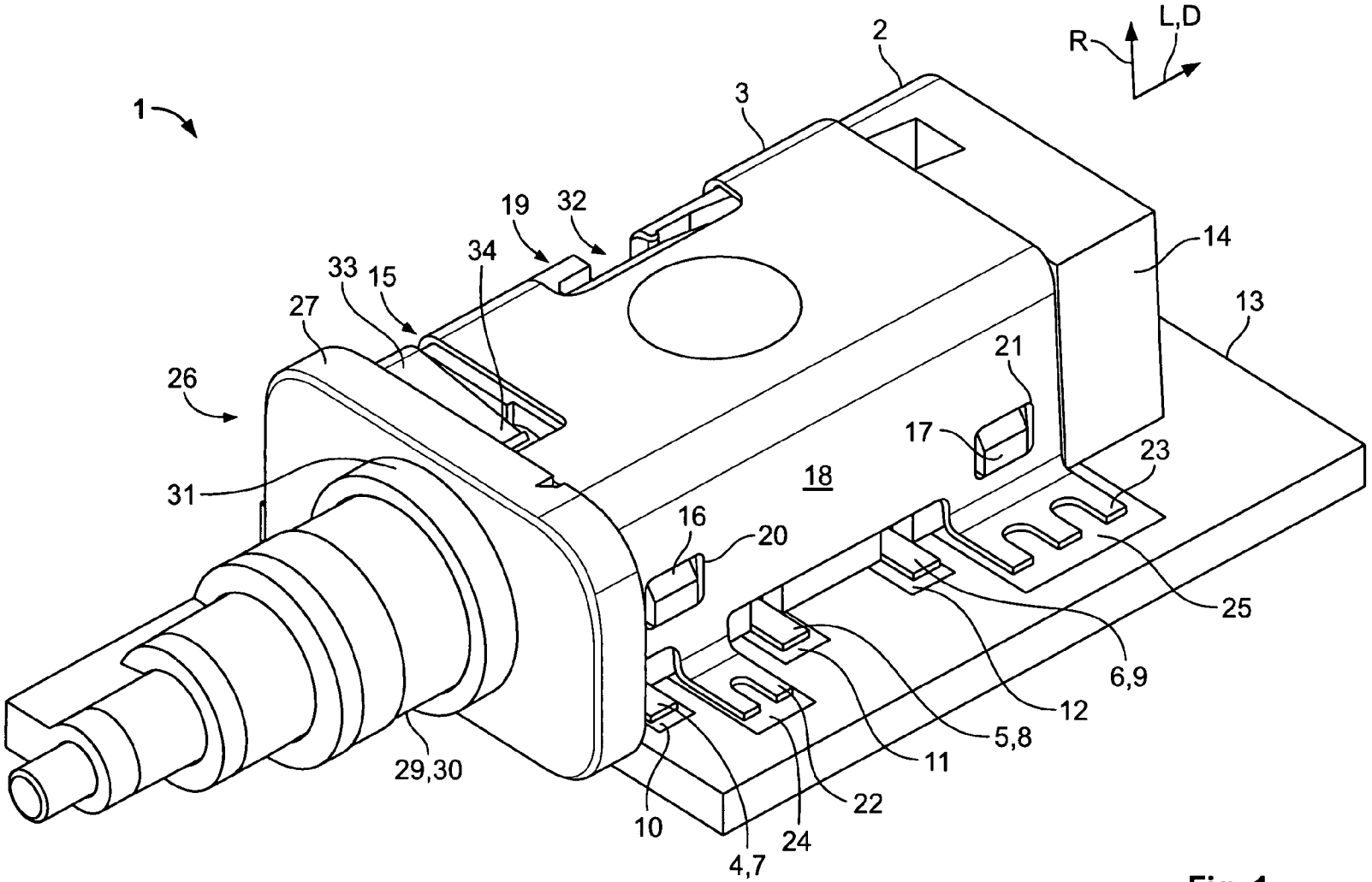
FIG. 1 is a schematic perspective view of a first embodiment of the electrical connector according to the invention.

A construction of an electrical connector 1 according to the invention will firstly be described in the following with reference to FIG. 1, which shows a schematic perspective view of the connector 1. The connector 1 is shown with a body part 2, a shell 3 and three contact members 4 to 6. Contact member 4 is the first contact member of the connector 1 in a longitudinal direction L of the connector 1. The next contact member is contact member 5, which in turn is followed in the longitudinal direction L by contact member 6. Contact ends 7 to 9 of the contact members 4 to 6 protrude from the body part 2 and bear on contact pads 10 to 12 of a substrate 13, the substrate 13 itself not being part of the connector 1. The substrate 13 may be a printed circuit board, which provides for conductive tracks connected to the contact pads 10 to 12 in a signal conductive manner. The contact ends 7 to 9 are formed as SMD-contacts and are soldered to the contact pads 10 to 12.

The body part 2 is arranged between the shell 3 and the substrate 13 and is at least partially enclosed by the shell 3. The body part 2 can even be clamped between the shell 3 and the substrate 13. Long sides 14, 15 of the essentially box-shaped body part 2, which extend perpendicular to the substrate 13 and along the longitudinal direction L of the connector 1, are provided with latch noses, of which only the latch noses 16, 17 of the side 14 are shown. The latch noses 16, 17 protrude through latch openings arranged in side walls 18, 19 of the shell 3, which has an essentially U-shaped cross-section. In FIG. 1, only latch openings 20, 21 are visible. The latching elements of the body part 2 and the shell 3 can be arranged symmetrically to the longitudinal direction L. The shell 3 is latched to the body part 2 via the latch noses 16, 17 and the latch openings 20, 21.

Ends of side walls 18, 19 that are pointing towards the substrate 13 continue in fastening members, of which only fastening members 22, 23 are shown. The fastening members 22, 23 are fixed to the substrate 13 and can for instance be screwed or glued to the substrate 13. In the displayed embodiment, however, the fastening members 22, 23 are also formed as SMD-pads and are soldered to contact pads 24, 25 of substrate 13, on which they bear on. Contact pads 24, 25 can for instance be connected with a ground for electro-static discharge protection purpose. Especially for this purpose, the shell 3 can consist of conductive sheet metal and be produced by a punching process.

A front 26 of the body part 2 points against a plug direction D, in which a jack 29 can be inserted into a contact volume 28 of the body part 2 in the longitudinal direction L. The front 26 is shaped with a collar 27, which extends perpendicular to the substrate 13 and in which the contact volume 28 ends. The contact volume 28 extends parallel to the substrate 13 and along the longitudinal direction L. Also the body part 2 and the shell 3 extend along the longitudinal direction L.

Through the collar 27 the jack 29 is inserted, of which only a cable junction 30 is visible. The cable junction 30 is provided with a collar 31, which abuts the front 26 of the body part 2. A contact section 32 of the jack 29 is completely inserted into the contact volume 28 in the plug direction D. The jack 29 and in particular its contact section 32 can be shaped as a standard 2.5 mm, 3.5 mm or 6.5 mm stereo jack which comprises three contact sections, which are electrically connected to contact members 4 to 6. Alternatively, jack 29 can be provided with more or less contact sections and the electrical connector can be provided with an adequate amount of contact members 4 to 6.

The switch contact 33 is at least section-wise punched out of the shell 3, still being connected to the side wall 19 that is arranged opposite of the contact member 4. It goes without saying that the switch contact 33 can alternatively be connected to side wall 18. Here, however, it is connected to side wall 19 and comprises a free end 34, which points towards the contact member 4 and away from the side wall 19. The switch contact 33 is slightly bent towards the contact volume 28 and is arranged at an end F of the shell 3 facing against the plug direction D, which is arranged adjacent to the front 26 of the body part 2. The free end 34 forming the tip of the tongue-shaped switch contact 33 can elastically be deflected in and against a radial direction R that runs perpendicular to the longitudinal direction L.

Figure 2:
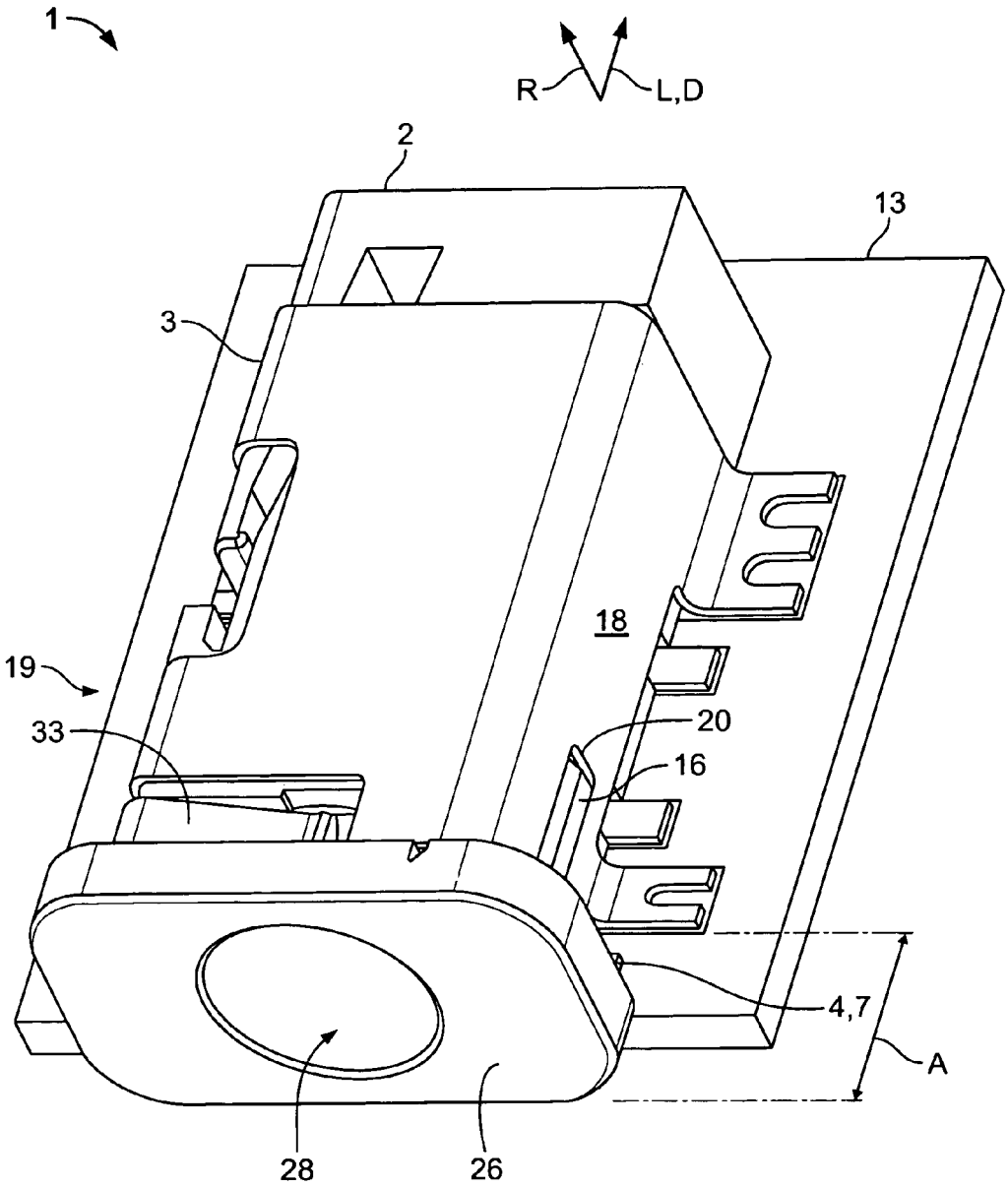
FIG. 2 is a schematic perspective view of another exemplary embodiment.

FIG. 2 shows a further exemplary embodiment of the electrical connector 1 according to the invention in a schematic perspective view, the same reference signs being used for elements which correspond in function and structure to the elements of the exemplary embodiment of FIG. 1. For the sake of brevity, only the differences from the exemplary embodiment of FIG. 1 will be described.

In FIG. 2, the jack 29 is not inserted into the contact volume 28. It can be seen that the contact volume 28, which opens in the front 26, is of an essentially circular cylindrical shape. In this embodiment, the side walls 18, 19 of the shell 3 are only provided with one latch opening, of which only latch opening 20 is visible. Through the latch opening 20 protrudes a latch nose 16 of the body part 2.

The shell 3 encloses the body part 2 at least in the radial direction R, ends in the area of the front 26 of the body part 2 and is affixed to the substrate 13, such that it can absorb mechanical forces introduced by the jack 29 especially in the radial direction R and convey those forces into the substrate 13. By way of arranging the shell 3 against the plug direction D in the area of the front 26, the resulting length of a lever, whose length A is determined by the distance from the front 26 to the shell 3, is minimized. In particular, the length A of the lever is determined by the distance between the front 26 and the first fastening member 22 in plug direction D. If the body part 2 is shaped without a collar 27, the shell 3 can reach to the front 26 and the length A can become zero, resulting in an optimum fixation of the connector 1 to the substrate 13. The lever transforms the mechanical forces acting in the radial direction R into a torque that seeks to dislocate the connector 1 with respect to the substrate 13. Thus, forces in radial direction R, which would normally peel off the connector 1 of the substrate 13, can be resisted due to the construction according to the invention.

The switch contact 33 is integrated into the shell 3 and thus is an integral part of the shell 3. A separate switch contact is not necessary on the shell side of the switch. The function of the switch contact 33 in conjunction with the first contact member 4 is apparent in the following figures.

Figure 3:
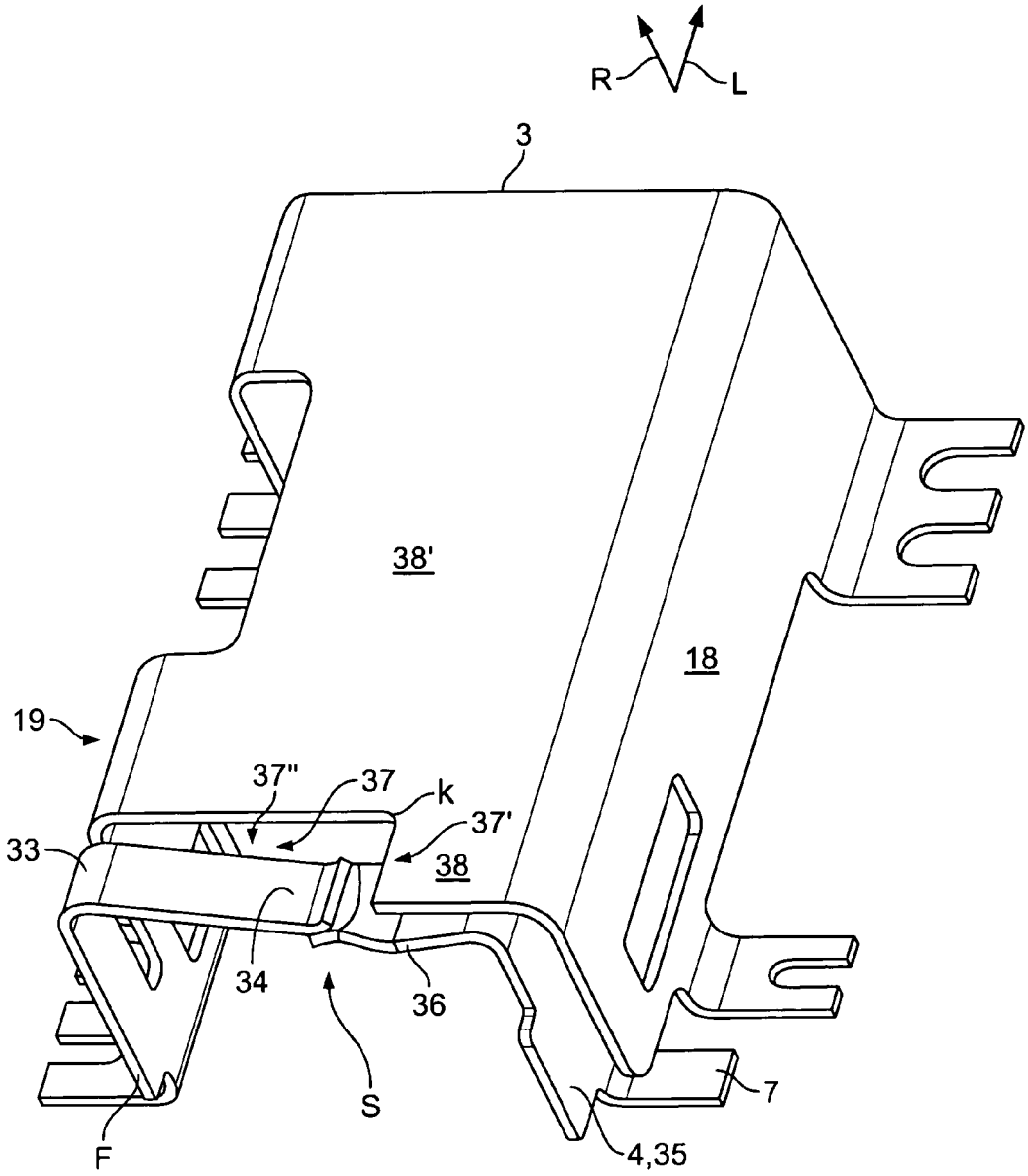
FIG. 3 shows the embodiment of FIG. 2 with a body section of the electrical connector being omitted.

FIG. 3 is a schematic perspective view of the electrical connector 1 according to the execution example of FIG. 2. The body part 2 and the substrate 13 are, however, not shown. Furthermore, contact members 5 and 6 are omitted. Only the shell 3 and the first contact member 4 are shown. Yet, contact member 4, which is held in position by the body part 2 due to e.g. a form fit, is still in position.

The first contact member 4 is electrically not connected to the shell 3 and in particular arranged in a distance of the free end 34 of the switch contact 33. The contact member 4 is essentially of a Z-shape, the contact end 7 extending in a plane defined by the substrate 13. A middle section 35 of the contact member 4 runs away from the substrate 13 and essentially parallel to the radial direction R. At its end facing away from the contact end 7, the middle section 35 is bent and a following contact section 36 of the contact member 4 runs essentially parallel to the contact end 7 but facing away from it.

The contact section 36 of contact member 4 is overlapped by the free end 34 of the switch contact 33 in the radial direction R and forms a separate switching element 33', the switch contact 33 and the separate switching element 33' forming a switch S.

The switch contact 33 is at least section-wise separated from the remaining shell 3 by an essentially L-shaped slot 37. A section 37' of the slot 37 begins at the front F that faces against the longitudinal direction L and runs parallel to the longitudinal direction L, then it forms an essentially rectangular hook k and turns towards one of the side walls 18, 19 and in particular to the side wall opposite to the contact member 4—in this example side wall 19. This second section 37" of the slot 37 extends up to the side wall 19, in which it ends.

Transverse to the longitudinal direction L and next to the first section 37' of the slot 37 a clamp plate 38 extends between the switch contact 33 and the side wall 18. The clamp plate 38 runs parallel to the longitudinal direction L and the plane defined by the substrate 13 and at least section-wise overlaps the body part 2 in the radial direction R. Forces, introduced by the jack 29 and being directed in the radial direction R, are mainly absorbed by the clamp plate 38 and a consecutive section 38' of the shell 3, the consecutive section 38' being arranged behind the clamp plate 38 in the longitudinal direction L.

Especially the size of the switch contact 33 in and transverse to the longitudinal direction influences the maximum retention force the shell 3 can absorb. The larger the clamp plate 38 and the consecutive section 38' of the shell 3, the higher the maximum force which can be absorbed by the shell 3. Yet, the free end 34 of the switch contact 33 has to be reachable/contactable by the contact section 36 of the separate switching element 33' when the jack 29 is being inserted into the contact volume 28.

Figure 4:
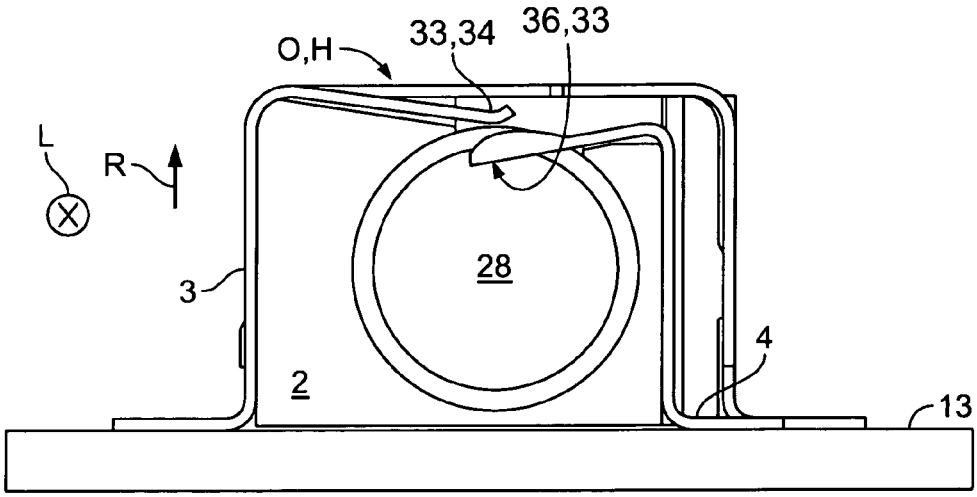
FIGS. 4 to 6 show the embodiment of FIGS. 2 and 3 in a schematic sectional frontal view.
Figure 5:
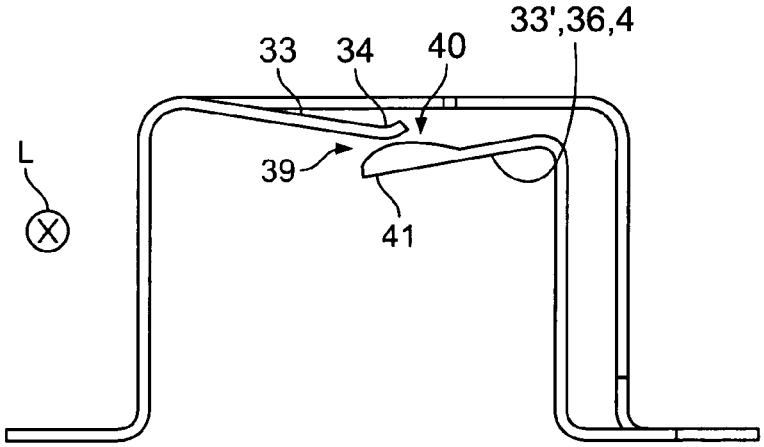
Figure 6:
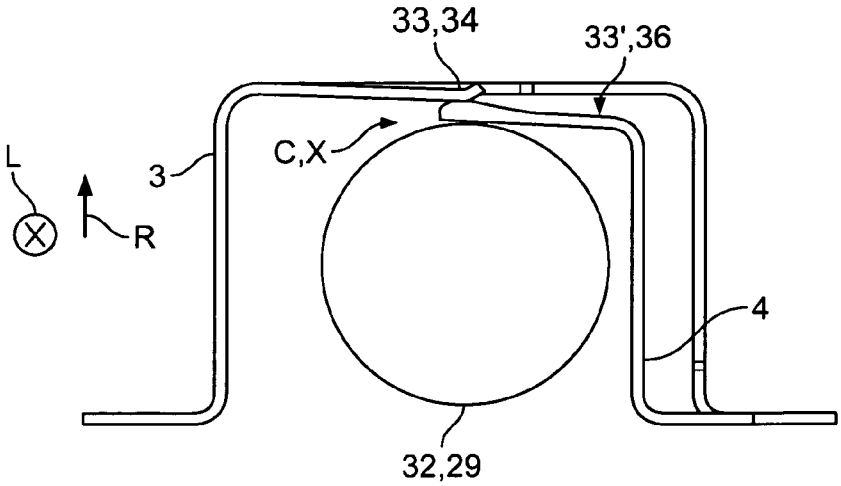

FIGS. 4 to 6 display the embodiment of FIGS. 2 and 3 in a schematic view in the longitudinal direction L, which is directed into the plane of projection.

In FIG. 4, the electrical connector 1 is shown with the body part 2, the shell 3 and the contact member 4. The electrical connector 1 is arranged on the substrate 13 and the collar 27 is omitted. The free end 34 of the switch contact 33 and the contact section 36 of the separate switching element 33' form the switch S, which is displayed in an open state O. In the open state O the switch contact 33 and/or the separate switching element 33' are in a home position H, in which they are not deflected. This means that no external forces are acting onto the switch contact 33 and the separate switching element 33', the forces in particular being caused by the jack 29 when it is inserted into the contact volume 28. Without the jack 29 being inserted into the contact volume 28, contact section 36 of contact member 4 at least partially extends into the contact volume 28.

In FIG. 5, the body part 2 is omitted completely. Yet, contact member 4, which is held in position by the body part 2 due to e.g. a form fit, is still in position. Without the body part 2, a clearance 39 between the switch contact 33 and the separate switching element 33' is clearly visible, the clearance 39 being the result of the open state O. Into the clearance 39 a contact bump 40 extends towards the free end 34 of the switch contact 33. The contact bump 40 is part of the contact section 36 of the contact member 4 and is arranged in the area of a free end 41 of the contact section 36.

In FIG. 6, the electrical connector 1 is shown with the shell 3 and the contact member 4. Again, the body part 2 is omitted. However, the contact section 32 of the jack 29 is shown inserted into the contact volume 28.

The contact section 32 essentially fills out the contact volume 28 and therefore pushes the contact section 36 of the separate switching element 33' out of its home position H into a deflected position C that lies behind the home position H in radial direction R. Due to this placement of the contact section 32, contact member 4 is elastically deformed. Hence, in order to enable the elastic deformation of the contact member 4/the elastic displacement of its contact section 36, at least contact member 4, but also contact members 5 and 6 can be shaped as spring contacts.

The contact section 36 has been this far displaced in radial direction R that it is in contact with the free end 34 of the switch contact 33. The clearance 39 is gone and the switch S has reached its closed or conductive state X.

In order to keep the switch S closed, even if external forces like mechanical vibrations act upon the electrical connector 1, the jack 29 can deflect the contact section 36 of the separate switching element 33' so far that the free end 34 of the switch contact 33 is also elastically deflected in the radial direction R and presses against the contact section 36 and particularly against the contact bump 40 of the separate switching element 33'. The resulting elastic force secures the closed state X of the status switch S against e.g. the vibrations. Thus, it is advantageous if the switch contact 33 is also shaped as a spring contact.

The status switch S according to the above is a so-called normally open contact. Alternatively, the status switch S can be in its closed or conductive state X when the switch contact 33 and the separate switching element 33' are in their home position H, resulting in a normally closed contact. In the home position H, the switch contact 33 and separate switching elements 33' can be biased and press against each other, securing the closed state X. In the open state O the switch contact 33 or the switching element 33' is in the deflected position C.

The electrical connector 1 with the shell 3 and the contact member 4 provides for two functions, namely securing the connection of the connector 1 with the substrate 13 and providing for a status switch S for detecting the state of insertion of the jack 29 without the need for additional components.

The connector 1 may comprise more than one contact volume 28, the additional contact volumes being shaped with a status switch S according to the invention or without a switch S. Furthermore, the status switch S can be arranged at a distance from the first contact member 4 in plug direction D, detecting a state of insertion of the jack 29 in the middle or at the end of the insertion procedure. Especially, the switch S can be shaped as a final position switch, detecting that the jack 29 is completely inserted into the contact volume 28. Furthermore, two or more status switches S can be provided, for instance one status switch S in the area of each end of the contact volume 28.

The invention claimed is:

1. A female electrical plug connector, comprising:

an insulative housing having a contact volume for receiving a jack in a plug direction extending in a longitudinal direction of the contact volume, and a plurality of electrical contacts positioned along different longitudinal positions in the plug direction;

an outer conductive shell for securing the position of the connector housing relative to a substrate; and a status switch, which is adapted to be operated by inserting the jack into the contact volume in the plug direction, wherein the switch is at least partially integrated into the outer conductive shell, the status switch having an opened and closed switched position.

2. A female electrical plug connector according to claim 1, wherein the switch is formed at an end of the shell, the end facing against the plug direction.

3. A female electrical plug connector according to claim 1, wherein the shell has at least one fastening member adapted to be fixed to the substrate, the at least one fastening member being electrically conductively connected to the separate switching element depending on the insertion of the jack.

4. A female electrical plug connector according to any of claim 1, wherein the shell is made of an electrically conductive material.

5. A female electrical plug connector according to claim 1, wherein the shell abuts against a front facing against the plug direction of the connector.

6. A female electrical plug connector according to claim 5, wherein the front is formed with a collar.

7. A female electrical plug connector according to claim 1, wherein the switch comprises a switching element separate from the shell being moveable into and out of contact with the shell in dependence of the insertion of the jack into the contact volume.

8. A female electrical plug connector according to claim 7, wherein the shell at least partially overlaps the switching element in a radial direction running transverse to the longitudinal direction.

9. A female electrical plug connector according to claim 7, wherein the switching element is formed by a separate contact member adapted to connect the jack, which is the first contact member of the connector in the plug direction.

10. A female electrical plug connector according to 9, wherein the connector comprises at least one further contact member adapted to contact the jack, the at least one further contact member being arranged at a distance from the switch in the plug direction.

11. A female electrical plug connector according to claim 1, wherein the shell encloses a body part of the connector.

12. A female electrical plug connector according to claim 11, wherein the shell is fixed to the body part.

13. A female electrical plug connector comprising a contact volume for receiving a jack in a plug direction extending in a longitudinal direction of the contact volume, the contact volume comprising a plurality of electrical contacts positioned along different longitudinal positions in the plug direction, a shell for securing the position of the connector relative to a substrate and a status switch, which is adapted to be operated by inserting the jack into the contact volume in the plug direction, wherein the switch is at least partially integrated into the shell and comprises a switching element separate from the shell being moveable into and out of contact with the shell in dependence of the insertion of the jack into the contact volume.

14. A female electrical plug connector according to claim 13, wherein the switch is formed at an end of the shell, the end facing against the plug direction.

15. A female electrical plug connector according to 13, wherein the connector comprises at least one further contact member adapted to contact the jack, the at least one further contact member being arranged at a distance from the switch in the plug direction.

16. A female electrical plug connector according to claim 13, wherein the shell has at least one fastening member adapted to be fixed to the substrate, the at least one fastening member being electrically conductively connected to the separate switching element depending on the insertion of the jack.

17. A female electrical plug connector according to claim 13, wherein the shell is made of an electrically conductive material.

18. A female electrical plug connector according to claim 13, wherein the shell abuts against a front facing against the plug direction of the connector.

19. A female electrical plug connector according to claim 18, wherein the front is formed with a collar.

20. A female electrical plug connector according to claim 13, wherein the shell at least partially overlaps the switching element in a radial direction running transverse to the longitudinal direction.

21. A female electrical plug connector according to claim 20, wherein the switching element is formed by a separate contact member adapted to connect the jack, which is the first contact member of the connector in the plug direction.

22. A female electrical plug connector according to claim 13, wherein the shell encloses a body part of the connector.

23. A female electrical plug connector according to claim 22, wherein the shell is fixed to the body part.

24. A female electrical plug connector comprising a contact volume for receiving a jack in a plug direction extending in a longitudinal direction of the contact volume, the contact volume comprising a plurality of electrical contacts positioned along different longitudinal positions in the plug direction, a shell for securing the position of the connector relative to a substrate and a status switch comprises a switching element, which is adapted to be operated by inserting the jack into the contact volume in the plug direction, wherein the switch is at least partially integrated into the shell, the shell having at least one fastening member adapted to be fixed to the substrate, the at least one fastening member being electrically conductively connected to the separate switching element depending on the insertion of the jack.

25. A female electrical plug connector according to claim 24, wherein the switch is formed at an end of the shell, the end facing against the plug direction.

26. A female electrical plug connector according to any of claim 24, wherein the shell is made of an electrically conductive material.

27. A female electrical plug connector according to claim 24, wherein the shell abuts against a front facing against the plug direction of the connector.

28. A female electrical plug connector according to claim 27, wherein the front is formed with a collar.

29. A female electrical plug connector according to claim 24, wherein the status switch separate from the shell being moveable into and out of contact with the shell in dependence of the insertion of the jack into the contact volume.

30. A female electrical plug connector according to claim 29, wherein the shell at least partially overlaps the switching element in a radial direction running transverse to the longitudinal direction.

31. A female electrical plug connector according to claim 24, wherein the switching element is formed by a separate contact member adapted to connect the jack, which is the first contact member of the connector in the plug direction.

32. A female electrical plug connector according to 31, wherein the connector comprises at least one further contact member adapted to contact the jack, the at least one further contact member being arranged at a distance from the switch in the plug direction.

33. A female electrical plug connector according to claim 24, wherein the shell encloses a body part of the connector.

34. A female electrical plug connector according to claim 33, wherein the shell is fixed to the body part.

* * * * *